United States Patent [19]

Lerner

[11] 4,041,846

[45] Aug. 16, 1977

[54] METHOD OF MAKING CONTAINER STRIPS

[75] Inventor: Bernard Lerner, Hudson, Ohio

[73] Assignee: Automated Packaging Systems, Inc., Twinsburg, Ohio

[21] Appl. No.: 612,462

[22] Filed: Sept. 11, 1975

[51] Int. Cl.[2] ..... B31B 1/64

[52] U.S. Cl. ..... 93/35 PC; 93/33 R; 93/DIG. 1

[58] Field of Search ..... 93/DIG. 1, 33 H, 33 R, 93/8 R, 35 PC, 35 R; 53/29, 35, 183; 156/512, 515–518

[56] References Cited

U.S. PATENT DOCUMENTS

| | | | |
|---|---|---|---|
| 2,525,139 | 10/1950 | Ligon | 93/DIG. 1 |
| 2,759,524 | 8/1956 | Davis | 93/DIG. 1 UX |
| 2,805,700 | 9/1957 | Klasing et al. | 93/DIG. 1 |
| 2,990,875 | 7/1961 | Samuels et al. | 93/DIG. 1 UX |
| 3,006,257 | 10/1961 | Orsini | 93/DIG. 1 |
| 3,107,585 | 10/1963 | Nystrand | 93/35 PC X |

*Primary Examiner*—James F. Coan

*Attorney, Agent, or Firm*—Watts, Hoffman, Fisher & Heinke Co., L.P.A.

[57] ABSTRACT

Detachable container strips and method of making and using the strips are disclosed. The container strips are connected in side-by-side relationship by narrow thin bridges with adjoining container portions of the strips in registry with each other lengthwise of the strips. The strips can be fed through packaging machinery for loading side-by-side container portions simultaneously.

15 Claims, 19 Drawing Figures

Fig. 1
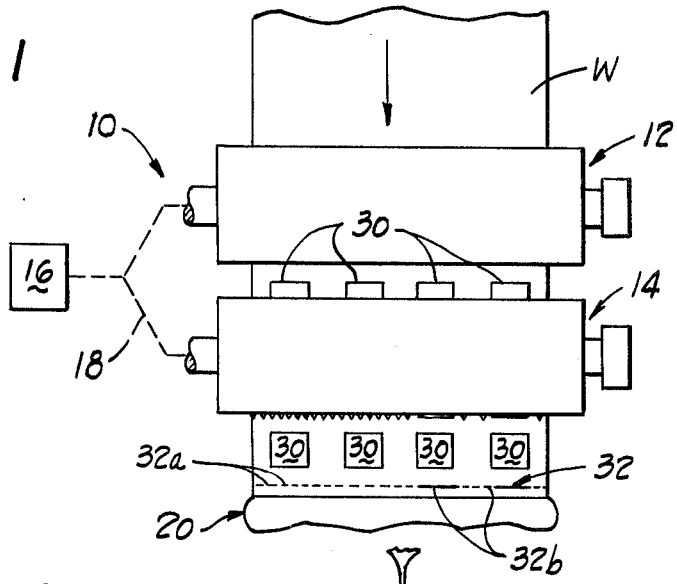
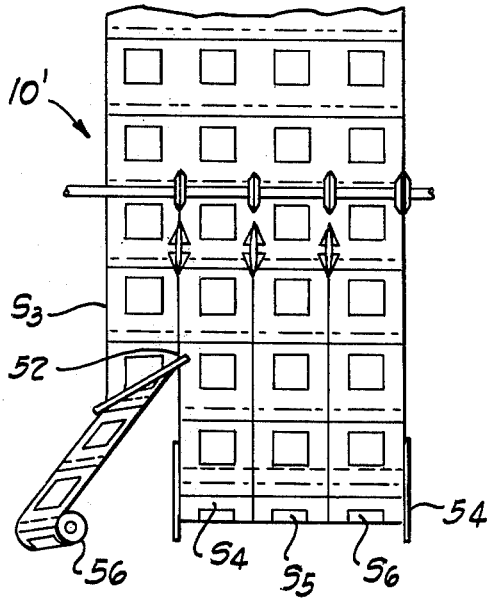
Fig. 1a
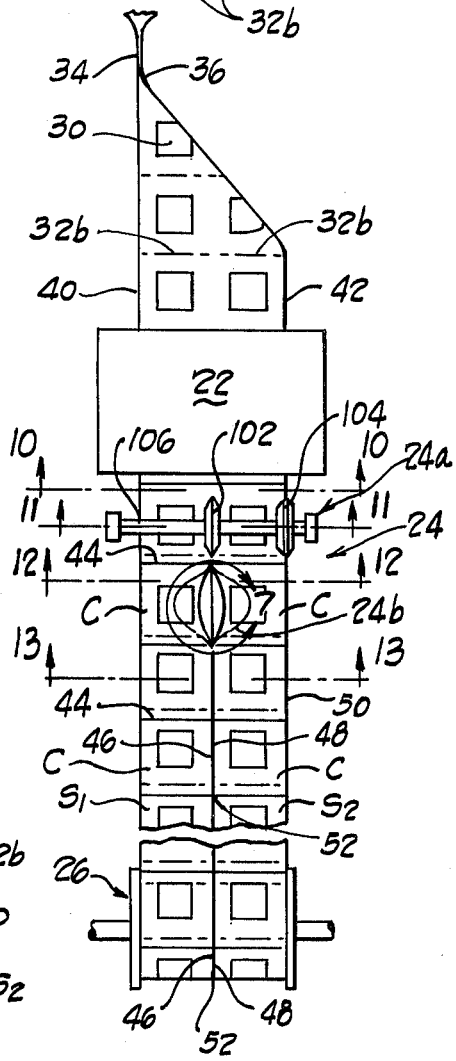
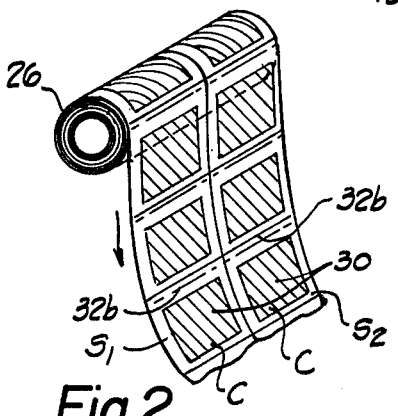
Fig.2

METHOD OF MAKING CONTAINER STRIPS

BACKGROUND OF THE INVENTION

1. Field of the Invention

The present invention relates to containers for packaging and more particularly relates to side-by-side detachably connected container strips and methods of making them.

2. The Prior Art

The packaging industry has developed a variety of so-called "form and fill" machines.

These machines are designed for use with products which are made and sold in high volumes. Such machines form a container from a web or webs of material, insert the product into the container to fill it and then seal the container to provide a finished package.

When products are made and sold in relatively low volume the complex and relatively expensive form-and-fill machines are uneconomic. While various mechanical aids have been developed, the loading and sealing steps involved in packaging low-volume products have been performed, at least in part, manually.

The developing of chains of open bags such as those shown and described in U.S. Pat. No. 3,254,828 entitled "Flexible Container Strips" and issued to Hershey Lerner presaged a system of packaging which is well suited to relatively low-volume applications. In its most popular form, this system uses a dispensing machine which carries a rolled web of connected and open bags. The bags are fed, closed end first, through a dispensing opening. As each bag emerges from the opening, a concurrent flow of air through the opening inflates the bag. The product to be packaged is inserted into the bag. Subsequently, the bag is both sealed to form a container and separated from the web.

Dispensing said sealing machines have been developed which automatically feed the bags sequentially to a station where they are loaded. Once each bag is loaded, the machine seals the bag and severs it from the web as a finished package. One such machine is disclosed in U.S. Pat. No. 3,815,318 issued on June 11, 1974 to Bernard Lerner entitled "Packaging Method and Apparatus". This machine may be coupled to automatic counting and loading equipment too for efficiently and automatically packaging products which are made in moderate volumes.

The dispensing and sealing machines have generally been constructed so that it is mechanically possible to feed side-by-side container strips through the machine simultaneously from a strip storage location to loading and sealing stations. Concurrent feeding of a plurality of strips has the desirable effect of multiplying the machine's capacity. While this effect is desirable, it has not, as a practical matter, been achieved in the past.

Simultaneous feeding, loading and sealing of side-by-side container strips has not been practical in the past because of the nature of the plastic material from which the strips are made. Normally, container strips are formed from a heat-sealable plastic material, such as polyethylene, which has a tendency to yieldably stretch during container strip forming process.

Slight stretching of the material is extremely difficult to avoid during the forming processes and the result is that slight dimensional errors in the length of individual container portions are created as the material is fed through strip-forming apparatus. The dimensional error introduced in an individual container portion is of negligible consequence so far as the affected container portion itself is concerned, but these individual errors accumulate over the length of the container strip. If a dimensional error of 0.001 inch is present in each container portion of a container strip having 3000 container portions, the last container portion of the strip is offset 3 inches along the web from where it should theoretically be located.

When a single container strip is fed through one of the described dispensing and loading machines, a cumulative effect of dimensional errors is avoided by controlling the strip feed in response to sensing successive container portion locations along the strip. However, if side-by-side container strips are simultaneously fed through this machine, extremely small differences in dimension of container portions of one strip relative to the dimensions of container portions of another strip produce a cumulative error resulting in the container strips being moved out of registry with each other rather promptly. For example, if each container portion of the adjacent container strip, simultaneously feeding one thousand container portions of side-by-side strips to the loading station will result in an accumulated 1 inch difference between corresponding load openings of the strips. This has precluded simultaneously loading and sealing container portions of side-by-side container strips with the described loading and sealing machines.

The prior art has proposed no practical solution to the problem of how to concurrently supply container strips while maintaining registration. Utilization of the known art results in either or both the dispensing and sealing machines being extensively modified, or the finished package being unattractive in appearance, and perhaps other standpoints.

SUMMARY

The present invention provides container strips and a method of making container strips in attached, side-by-side relationship. The container strips are readily detachable but connected to provide the necessary registration for simultaneous packaging of articles in side-by-side container portions. The individual packages formed from the container portions have flush cut sides so that the attractiveness of the packages is comparable to those formed from the prior strips which are typically loaded one container at a time.

According to the invention a plurality of side-by-side web-like container strips having individual container portions accurately registered with each other throughout the length of the strips are provided. Adjacent side edges of the container strips are formed by narrow seal beads and the strips are detachably connected to registration with each other by bridges of the plastic material extending between the beads. When used in packaging machinery, the container strips are fed as a unit toward a loading station, and adjacent container portions are simultaneously loaded and closed.

Once an individual container has been loaded, sealed and severed, it provides a finished package which is virtually indistinguishable from one formed from a conventional plastic bag. Accordingly, the package is attractive and fully acceptable commercially.

In an illustrated embodiment of the invention, the container strips are formed from confronting plies of film-like heat-sealable plastic material defining successive container portions. Each container portion has one end defined by a transverse line of weakness along which the container portion is separable from the strip, side edges along which the plies are joined, and a loading opening through which articles are loaded into the container portion.

In one preferred form, adjacent side edges of the container strips are formed at least in part by separate narrow heat seal beads along which the plies are fused. These beads are connected by narrow bridges of the material which are of substantially lesser thickness and strength than the beads and the remaining ply material so that the container strips are readily separable when desired.

The container strips are formed simultaneously with adjacent container portions transversely registered with each other along the length of the strips. The connecting bridges are formed while the adjacent container strip portions are maintained in transverse registry so that the bridges maintain the adjacent container strips transversely registered throughout the entire strip length.

After production, the container strips are preferably wound on storage mandrels, or reels, for shipment to a packager. Any desired number of connected side-by-side container strips can be wound together on a single mandrel. Container strips are removable from the mandrel simultaneously by letting the container strips off the mandrel together; or successively, by letting off one strip at a time. The strips let off from the mandrel, either simultaneously or successively, are fed to a loading station. The strips are sufficiently easily separated that successive feeding of a single strip from a roll of connected side-by-side strips is readily accomplished without damaging the strips.

In one preferred method of making the container strips, longitudinally extending heat seals are formed on the web to define side edges of a plurality of side-by-side container strips. The side edge seals are narrow beads defined by fusing the web plies together along a line. The beads are preferably formed by flowing molten material laterally from the heat seal line so that the bead thickness is slightly greater than the total web thickness. The thus fused container strip edges are separated briefly while molten and are re-engaged while the seal beads are still hot, and at least tacky, so that the engaged beads cohere to each other to provide thin bridges by which the side-by-side strips are connected. The strips are maintained in transverse registration with each other while the molten beads are separated so that the strips are in registry after being connected by the bridges.

In another preferred method of making the container strips, the plastic material is heated to a molten state along a narrow longitudinal sealing line to form adjacent sealed container strip side edges. The web plies are fused or welded together and molten plastic material is flowed oppositely from the sealing line to form narrow relatively thick seal beads. A small amount of the material remains undisplaced from the seal line so that when the plastic material cools and solidifies the side edge beads are connected by narrow extremely thin and weak bridges of the plastic material.

The molten plastic material can be entirely displaced from the sealing line at spaced locations to provide a discontinuous connecting bridge if desired. This construction further weakens the connection between the container strips.

The adjacent side edge seal beads extend continuously along each container strip and because the molten plastic material is displaced from the sealing line, the beads have a greater thickness than that of the web plies joined by the beads. Thus, even though the beads are extremely narrow, they are relatively strong compared to the web plies. The connecting bridges are of substantially less thickness than the beads and the web plies and accordingly, the adjacent container strip side edges are readily separable along the bridges without requiring the bead material to be torn or otherwise interrupted when the container strips are separated. The bridges are also of minimal width so that after separation of the container strips the side edges are of essentially "flush cut" appearance.

Other features and advantages of the invention will become apparent from the following detailed description of preferred embodiments made in reference to the accompanying drawings which form a part of the specification.

BRIEF DESCRIPTION OF THE DRAWINGS

FIG. 1 is a schematic plan view of an exemplary method by which container strips are made in accordance with the present invention;

FIG. 1A is a fragmentary view of a portion of apparatus for making multiple side-by-side container strips according to the invention;

FIG. 2 is a perspective view of container strips embodying the invention which are wound for use in a packaging machine;

DESCRIPTION OF THE PREFERRED EMBODIMENTS

Figure 3:
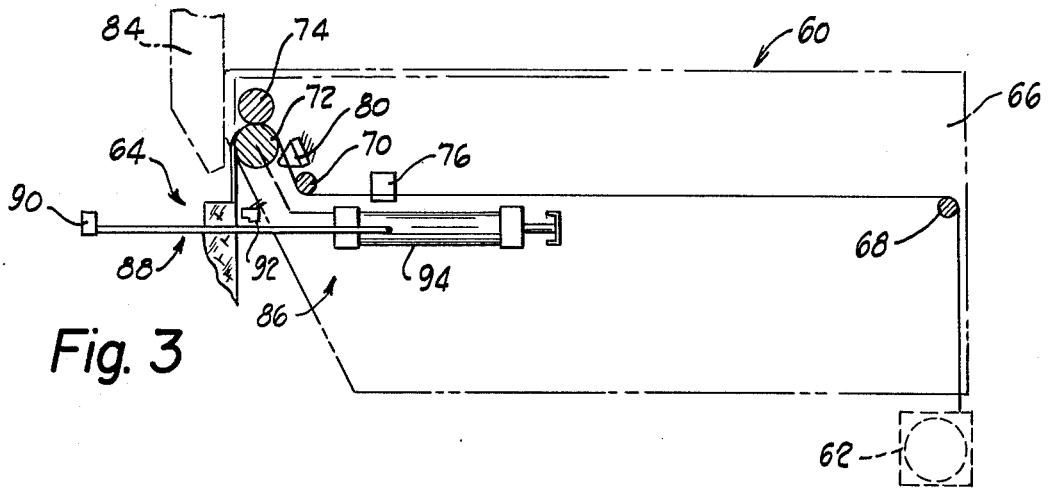
FIGS. 3, 4 and 5 are schematic representations of a packaging machine in which container strips embodying the present invention are used.

Referring now to FIG. 1, side-by-side detachable strips S1, S2 of containers are illustrated being produced from a web W of film-like heat-sealable material, such as polyethylene. A forming apparatus is generally indicated by the reference character 10. The apparatus 10 in the illustrated embodiment comprises a printing press 12 and a web-cutting mechanism 14, schematically shown. The press and cutting mechanisms are shown as driven in common by a motor 16 via a drive transmission 18. FIG. 1 also schematically illustrates other parts of the apparatus 10. These parts include a web folder 20, a heat sealing station 22 at which transverse heat seals are formed on the web W, a heat sealing station 24 at which longitudinal heat seals are formed on the web W, and a storage mandrel 26 on which the strips S1, S2 are wound.

As the web W passes through the printing press 12, printed images 30 are formed at transversely aligned locations on the web. The web-cutting mechanism 14 operates in concert with the printing press 12 to provide a series of lines of weakness 32 across the web W, each line of weakness having a predetermined spaced relationship along the web with respect to the printed images 30. In the preferred and illustrated embodiment, each line of weakness is formed by a series of closely spaced perforations, indicated at 32*a*, which extend approximately halfway across the width of the web and elongated slits 32*b* formed in the other half of the web.

As the web emerges from the cutting mechanism 40, it passes across the folder 20 so that the web is folded in half to produce confronting plies 34, 36 defining folded web side edges 40, 42. The web W is folded in half so that the printed images 30 on the respective plies 34, 36 are aligned with each other and the perforations 32*a* are disposed coextensively with the slits 32*b*. The folded web is fed through the transverse heat sealing station 22 at which a series of transverse heat seals 44 are formed in a predetermined registered relationship with the lines of weakness 32 and the printed images 30. The transverse seals 44 are formed by fusing the material of the plies 34, 36 together along a transverse line which extends entirely across the folded web between the side edges 40, 42.

The folded web next passes through the longitudinal heat sealing station 24 which is effective to sever the folded web along a longitudinal line as well as sealing the severed edges of the web by heat seal beads 46, 48. The station 24 is also effective to produce an edge seal 50 by which the folded web has been formed into separate side-by-side container strips S1, S2. Each strip is defined by a longitudinal series of connected container portions C. Each container portion has a closed end defined by its transverse seal 44, an open end defined by its slit 32*b* and detachable from successive container strip portions along its line of weakness 32. The container portions C of the strips are transversely registered with each other by virtue of their common production from the web W.

The longitudinal heat sealing station 24 is constructed to separate the container strips S1, S2 immediately after the beads 46, 48 are formed and while the material of the beads 46, 48 is molten. The material forming the beads is allowed to cool somewhat after which the beads are again engaged while the bead forming material is still tacky. This separation and reengagement produces a connecting bridge structure 52 between the beads 46, 48 by cohesion of the still tacky bead material. The connecting bridge structure is of substantially less thickness than the thickness of the folded web and the beads 46, 48 and is structurally weak. Accordingly, the beads 46, 48 are easily separable without tearing either container strip, yet the printed images 30, transverse seals 44 and lines of weakness 32 of the container strips S1, S2 are maintained accurately aligned as the connecting bridge structure 52 is formed.

The side-by-side detachable connected strips S1, S2 are then wound onto the mandrel 26. The mandrel 26 is associated with known apparatus (not shown) which is effective, when a predetermined length of the container strips S1, S2 has been wound onto the mandrel 26, to transversely sever the strips S1, S2 and transfer the strips being fed from the apparatus 10 to another mandrel for winding without terminating operation of the apparatus.

FIG. 1A shows a modified portion of apparatus 10′ in which four container strips S3, S4, S5, S6 are formed at once. The container strips S3–S6 are identical to the strips S1, S2 referred to in connection with FIG. 1. The container strips S4 S5 and S6 are wound on a common mandrel 54 while the container strip S3 is wound on an individual mandrel 56 by separating the container strips S3 and S4 along the connecting bridge 52 between them.

The container strip forming apparatus generally indicated at 10 and 10′ is constructed to produce any desired number of side-by-side detachably connected container strips. The container strips can be commonly wound on a storage mandrel or separated in any desired combinations for winding on separate storage mandrels.

The container strips are illustrated as formed, so that each container portion C is fed onto its mandrel open end first. This enables the container strips to be let off from the associated storage mandrel closed end first, as is illustrated in FIG. 2. Thus, when the container strips S1, S2 are removed from their mandrel by a packager, the container portions C being loaded are supportable at a loading station by the associated container strip when an article, or articles, being packaged are inserted in the load openings formed by the slits 32*b*.

For speed in production, it is often desirable to feed the webs in the opposite direction. That is, it is desirable to form the webs such that the closed end of the bag is fed onto the mandrel first. In this event, the rolls of material are rewound before shipment so that bags will have a mandrel closed end first.

Figure 4:
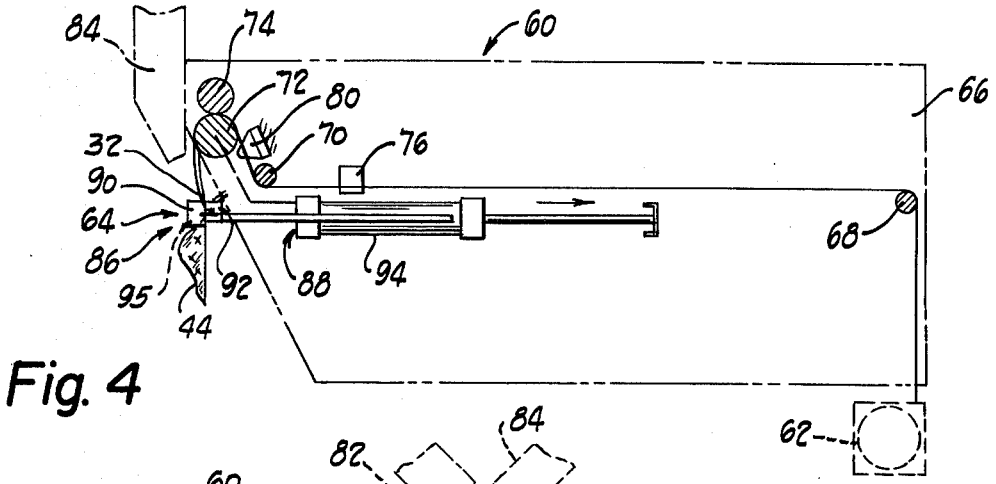
Figure 5:
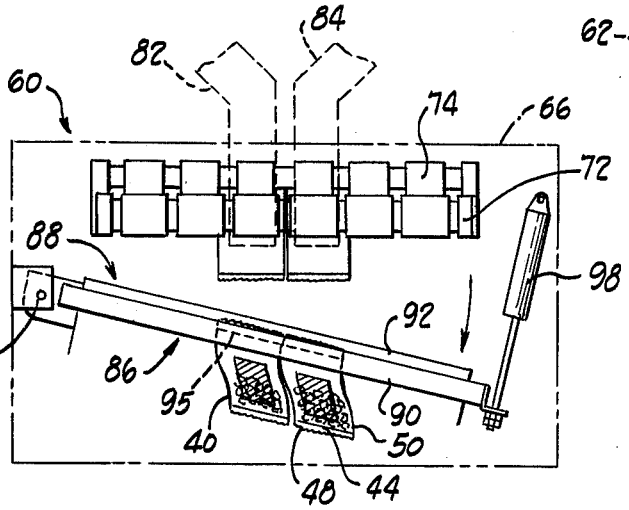
Figure 7:
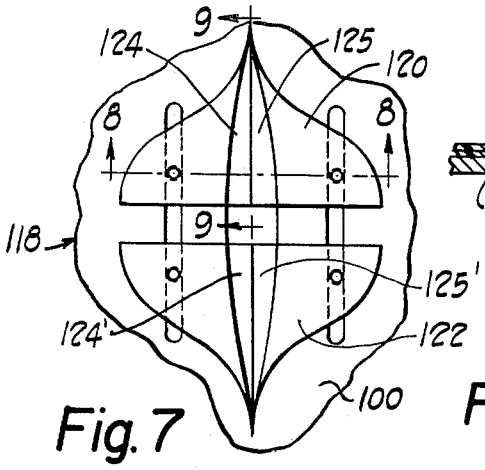
FIG. 7 is an enlarged fragmentary view of a portion of the apparatus of FIG. 1 shown within the line 7 of FIG. 1.
Figure 8:
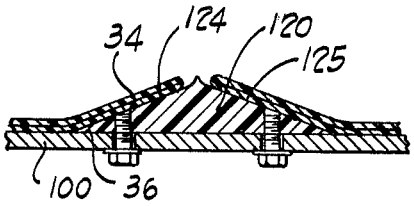
FIG. 8 is a fragmentary cross-sectional view seen approximately from the plane indicated by the line 8—8 of FIG. 7.

Referring now to FIGS. 3–5, a dispensing, sealing and severing type packaging machine 60 is schematically illustrated. The container strips S1, S2 are supported on their storage mandrel at a storage location 62 in the machine 60. The machine 60 feeds the strips to a loading station 64 at which the individual container portions C of the strips S1, S2 are simultaneously loaded. The loaded portions C are then sealed and severed from the respective strips S1, S2.

The machine 60 has a housing 66 (illustrated by broken lines) which supports container strip feed rolls 68, 70, 72, 74. The rolls 72, 74, are driven by a suitable motor (not illustrated) to enable the strips S1, S2 to be fed from the storage location 62 to the loading station. The container strips, S1, S2 are fed together and intermittently so that successive container portions C of each strip are registered at the loading station 64 under the control of a sensor assembly 76 which is schematically shown and disposed within the machine housing 66.

The sensor assembly 76 detects the presence of an identifiable part of a container strip arriving at a given location along the feed path. After the container strip part is detected, the motor controlling the feed rolls 72, 74 is stopped when the load opening slits **32*b* are properly positioned at the loading station. The sensor assembly 76** and associated motor controlling circuitry may be of known construction, for example, as shown in U.S. Pat. No. 3,477,196.

In the preferred and illustrated embodiment of the invention, the container portions C of the respective strips S1, S2 which are positioned at the loading station 64 are separated from each other. This is accomplished by stationing a separating blade structure 80 within the machine housing 66 adjacent the rolls 72, 74. The blade structure 80 extends through the plane of the container strips S1, S2 and is aligned with the connecting bridge 52 so that as the strips S1, S2 are fed through the rolls 72, 74 the blade 80 interrupts the connecting bridge structure 52. This detaches the adjacent edge seal beads 46, 48 of the container strips S1, S2 as they are fed past the blade structure.

The blade structure 80 in the preferred embodiment does not have a sharp cutting edge because the connecting bridge 52 is quite fragile compared to the adjacent heat seal beads and the web plies. Accordingly, the container strips S1, S2 are separated without requiring a sharp-edged cutting device which could otherwise cut or tear the beads 46, 48.

The separated container strips S1, S2 are fed to the loading station 64 through the rolls 72, 74. When the load opening slits **32*b* of the container portions C at the ends of the container strips S1, S2 are stationed below and immediately adjacent the discharge ends of article guides 82, 84, strip feeding is terminated. A suitable blower (not shown) is disposed within the housing 66 and directs a stream of air along the container portions at the loading station which blows open the positioned container portions for loading. Articles to be packaged are then dropped through the respective article guides 82, 84** into the container portions at the loading station.

The loaded container portions C are closed, sealed and severed from their respective strips S1, S2 by a sealing and severing mechanism 86 situated at the loading station. The mechanism 86 includes a heat sealer assembly 88. The sealer assembly has a heat sealing bar 90, a clamping bar 92 and a pneumatic ram type actuator 94. The actuator 94 moves the heat sealing bar 90 toward and away from the clamping bar 92 to clamp and declamp the loaded container portions between the bars 90, 92. After the container portions have been loaded, the actuator 94 operates to clamp them between the bars 90, 92 along a clamping line spaced downwardly from the line of weakness 32 of each container portion. The bar 90 includes a heater sealer element which, when engaged with the container portions, produces a transverse closure seal 95 extending completely across each container portion. The bars 90, 92 are preferably constructed to mechanically engage and clamp the container portions at locations above and below the heat sealer element so that tensioning stresses cannot be transmitted to the seal 95 from the respective strips S1, S2 and as a result of the weight of the articles supported in the container portions. These tensioning forces might otherwise adversely affect the integrity of the seal 95 if applied to the seal when molten or heat softened.

The sealer assembly 88 is supported on the housing 56 by a hinge 96, FIG. 5, at one of its ends and a pneumatic ram type actuator 98 at its opposite end. While the loaded side-by-side container portions C are clamped between the bars 90, 92 the actuator 98 is operated to pivot the assembly 88 about the hinge 96 away from the container strips, causing the clamped container portions C to be detached from their respective container strips along the lines of weakness 32. After the container portions are detached, the bars 90, 92 are separated by the actuator 94 and the now sealed, separate packages containing articles are dropped from the loading station. The actuator 98 then returns the sealer assembly 88 to its initial position (FIGS. 3 and 4) so that a subsequent sealing and severing cycle can be performed.

Figure 6:
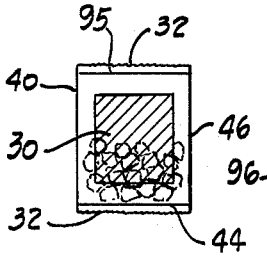
FIG. 6 is an elevational view of a package produced by the container strips and machine illustrated in FIGS. 2–5.

FIG. 6 illustrates a complete package. The package has an end seal 44, an opposite end seal l95 formed by the packaging machine 60 and flush cut side edges. If desirable or necessitated by the construction of the packaging machine itself, the strips S1, S2 can be loaded and sealed without automatically separating the container portions being loaded. For example, the loaded container portions can be manually separated from their container strips, heat sealed to close the package and then manually separated from each other by tearing them apart above the bridge 52. Further strips of any desired number of finished packages can be formed by performing the severing step only after a predetermined number of connected packages have been formed.

A packaging maching substantially similar to the machine 60 is illustrated and described in detail in U.S. patent application Ser. No. 336,560. Reference should be made to the disclosure of that application, if further constructive details concerning the construction of the machine 60 are desired.

FIGS. 1 and 7–13 illustrate one preferred longitudinal heat sealing station 24 and its method of operation in forming the seal beads 46, 48, 50 and the connecting bridge structure 52. The heat sealing station 24 is defined by a longitudinal heat sealer **24*a* and a bridge forming structure 24*b*. FIGS. 8 and 10–13 illustrate various conditions of the web material passing through the station 24 and for purposes of illustration the web material thickness has been greatly exaggerated relative to other components of the station 24.** In actual practice, the web materials may have ply thickness of 0.010 inches or less.

Figure 11:
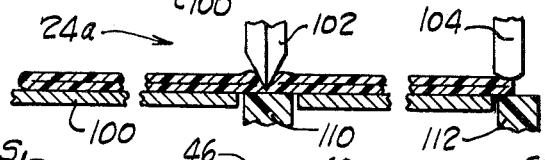
FIG. 11 is a cross-sectional view with parts broken away seen approximately from the plane indicated by the line 11—11 of FIG. 1.
Figure 12:
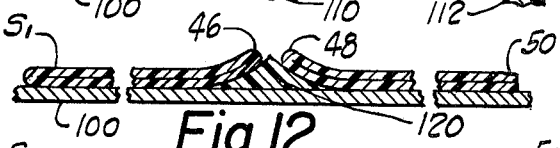
FIG. 12 is a cross-sectional view with portions broken away seen approximately from the line 12—12 of FIG. 1.
Figure 13:
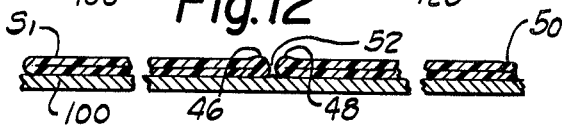
FIG. 13 is a cross-sectional view with portions broken away seen approximately from the plane indicated by the line 13—13 of FIG. 1.

The folded web W is fed to and through the station 24 on a container strip supporting feed table 100. The web W is first conveyed through the heat sealer **24*a*. The sealer 24*a* includes heated rotatable sealing rollers 102, 104 supported by a common shaft 106 and driven by a suitable motor (not shown). As shown in FIGS. 1 and 11, the rollers 102, 104 are disposed above the table 100 and engage the folded web against respective unheated backing rollers 110, 112. The rollers 110, 112 extend through slots in the table 100, and define peripheries which are tangent to the plane of the upper table surface. The peripheral surface speed of the rollers 102, 104 and 110, 112 are preferably the same as the feeding speed of the web W so that the web is neither stretched nor bunched by the rollers. The peripheries of the rollers 110, 112** are formed from a low-friction, non-adhesive material such as Teflon.

Figure 9:
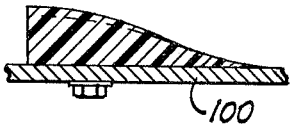
FIG. 9 is a fragmentary cross-sectional view seen approximately from the plane indicated by the line 9—9 of FIG. 7.

The rollers 104, 112 cooperate to form the longitudinal side edge seal 50 while the rollers 102, 110 form the seal beads 46, 48. As illustrated in FIG. 9, the roller 102 is chamfered to define a heated peripheral edge 114 which runs on the periphery of the backing roll 110. As the web feeds past the rollers 102, 110, the roller edge 114 melts through the web plies and melts the web material immediately adjacent the chamfered edge to fuse the web plies 34, 36 together. The chamfered periphery of the roller 102 creates a flow of the molten material away from the roller thus producing thickened, yet transversely narrow, weld beads which extend continuously along the adjacent container strip side edges.

The side edge seal 50 is formed as the free edges of the web W pass between the rolls 104, 112 which cooperate to heat and force the web edges together to fuse them and provide a narrow side seal for the container strip 52.

Immediately after formation of the seal beads 46, 48, the web passes the bridge forming structure **24*b* which separates the still molten beads 46, 48** from each other for a brief interval. During this interval, the beads are cooled while the container strips are maintained in accurate transverse registry with each other. The beads, while they are still softened and tacky, are re-engaged to cohere the beads together.

The bridge forming structure **24*b* is formed by a guide assembly 118 including guide members 120, 122 which are adjustably supported on the table 100. The guide member 120 defines strip guiding surfaces 124, 125 which are smoothly contoured to lift the beads 46, 48 away from the table 100 and laterally away from each other as the container strips are fed across the guide member 120. The surfaces 124, 125 are symmetrical with respect to a vertical plane extending in the web feeding direction so that the respective beads 46, 48 each travel through over identical path lengths as the web passes the member 120.**

The guide member 122 is identical to the guide member 120 but faces oppositely. The guide member 122 receives the web from the member 120 and guides the beads 46, 48 downwardly towards the table and towards each other so that as the web moves from the member 122 the beads 46, 48 are re-engaged. The guide surfaces 124', 125' of the member 122 are symmetrical like the surface 124, 125 so that the beads 46, 48 move through identical path lengths as they proceed across the respective surfaces 124', 125'. Accordingly, corresponding locations on the beads 46, 48 are separated and re-engaged as the web passes the assembly 118, each corresponding bead location having traversed an identical path length during the separation.

The guide members 120, 122 are adjustably movable towards or away from each other in the direction of the web feed to control the path length during which the beads 46, 48 move while separated. By controlling the separated path lengths, the time interval during the beads are allowed to cool is controlled so that the beads exhibit the proper degree of tackiness upon their re-engagement. The members 120, 122 are positioned with respect to each other as required by the heat transfer characteristics of the particular plastic web material being used and the feeding speed of the web.

Figure 10:
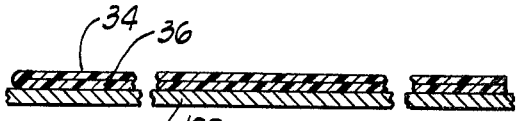
FIG. 10 is a cross-sectional view, with parts removed, seen from the plane indicated by the line 10—10 of FIG. 1.

FIGS. 10–13 illustrate movement of the container strip material through the station 24. As shown in FIG. 10, the container strip material is horizontally flattened on the table 100 as it proceeds towards the station 24 with the free edges of the plies 34, 36 aligned with the other. As the web passes through the heat sealer **24*a* the beads 46, 48 and 50 are formed as described and illustrated by FIG. 9. The beads 46, 48 are then separated by the guide assembly 118 while molten for a short period of time during which the temperature of the beads 46, 48 is reduced to a level at which the beads are tacky. When the container strips pass the guide assembly 118 the beads 46, 48 are again engaged with each other and the bridge 52 between the container strips S1, S2 is formed by cohesion of the tacky beads 46, 48.**

As shown by FIG. 11, the bridge 52 is of substantially less thickness than the beads 46, 48, as well as the combined thickness of the web plies. Hence the bridge 52 is relatively fragile compared to the remainder of the container strips S1, S2 and the container strips are easily separated without risk of tearing through the beads 46, 48 and with the material required for forming the bridge 52 being minimized. The bridge 52 may or may not be formed continuously along the strips but is formed so that the beads are cohered together at least at a large number of individual locations extending throughout the length of the containter strips.

FIGS. 14–17 show parts of another preferred longitudinal sealing station 140 for producing readily separable side-by-side container strips. In these figures, dimensions are exaggerated for clarity of illustration. The folded web W is advanced through the station 140 on a feed table 142 and between rollers 144, 146. The roller 144 is a heated sealing roller which is supported on a shaft 148. The roller 146 is unheated and is supported for rotation by a shaft 150 with its periphery extending through a slot in the table 142 and tangent to the upper table surface.

Figure 14:
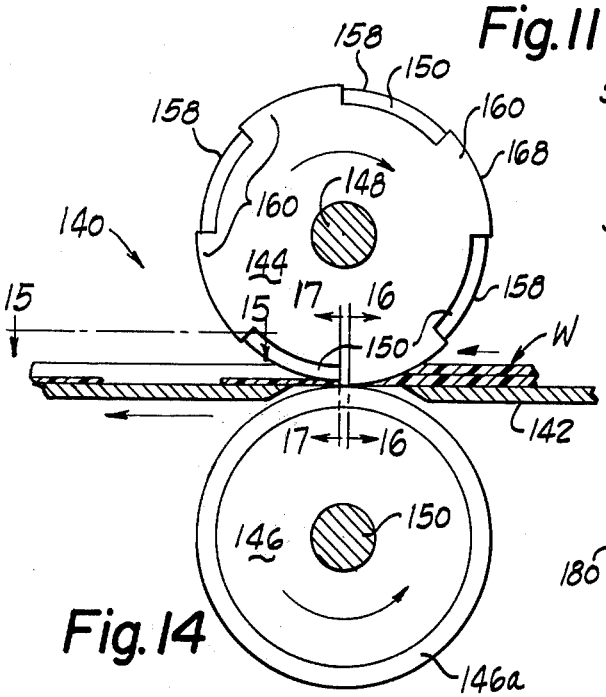
FIG. 14 is a vertical cross-sectional view of a modified portion of the apparatus illustrated in FIG. 1.
Figure 15:
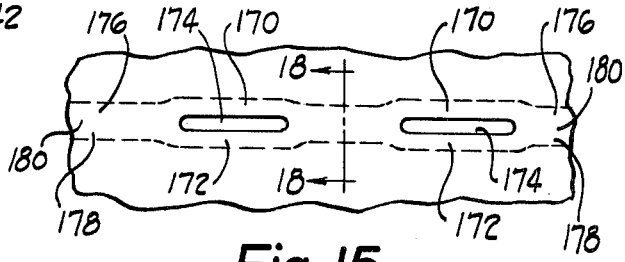
FIG. 15 is a fragmentary plan view seen approximately from the plane indicated by the line 15—15 of FIG. 14.
Figure 16:
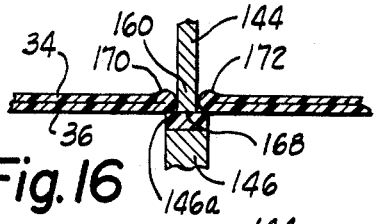
FIG. 16 is a fragmentary cross-sectional view seen approximately from the plane indicated by the line 16—16 of FIG. 14.
Figure 18:
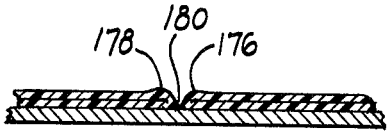
Figure 17:
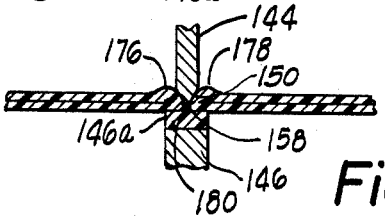
FIG. 17 is a fragmentary cross-sectional view seen approximately from the plane indicated by the line 17—17 of FIG. 14; and, FIG. 18 is a fragmentary cross-sectional view seen approximately from the plane indicated by the line 18—18 of FIG. 15.

The sealing roller 144 is constructed to produce narrow continuous longitudinal seal beads along adjacent sides of side-by-side container strips with the strips being interconnected by an easily separable discontinuous bridge of the container strip material. As shown in FIGS. 14, 16 and 17 the periphery of the roller 144 is formed by a series of chamfered segments 150, each defining a circularly curved edge 158, and interposed segments 160, defining generally cylindrical peripheral faces 168.

The roller segments 160 function with the roller 145 to seal and, at spaced locations, separate adjacent strip side edge points. As the web passes between the rollers 144, 146 the faces 168 melt through both plies of the web and engage the periphery of the roller 146 (see FIG. 16). The molten plastic flows laterally away from the faces 168 to form narrow thickened seal bead portions 170, 172. As these bead portions proceed away from the rollers 144, 146, they cool in place leaving a longitudinally extending series of openings 174 between the container strips where the material was displaced by the faces 168. The rim 146a of the roller 146 is preferably formed from a non-stick heat resistant material such as Teflon which will not adversely affect the formation of the seal portion 170, 172.

The edges 158 are located radially inwardly from the peripheral faces 168 so that while each face 168 contacts the periphery of the roller 146, the edges 158 just clear the periphery of the roller 146. As the edges 158 move into registry with the roller 146 each edge 158 melts through the upper web plies dispatching the molten plastic laterally from the edge 158 to form seal bead portions 176, 178 which are longitudinally continuous with the seal bead portions 170, 172. A narrow, relatively thin bridge 180 of the plastic material remains between the bead portions 176, 178.

The bridge 180 is of substantially lesser thickness than the seal bead portions 172, 174, the seal bead portions 176, 178 preferably of lesser thickness than the total thickness of the web plies. Accordingly, the bridges 180 are structurally weak and permit easy separation of the container strip side edge bead portions with minimal risk of tearing the container strips. The longitudinally spaced bridge openings 174 further weaken the juncture of the container strips to facilitate strip separation. Since the bridges 180 are formed simultaneously with the seal portions 176, 178, the strip container are maintained in registry during and after formation of the bridges.

If desired, the roller 146 can be formed with a circumferentially continuous chamfered periphery like the roller 102 and spaced from the backing roller 148 so that the peripheral edge of the roller 146 melts through the upper web 34 ply and part of the lower ply 36 as the web passes between the rollers 146, 148. the chamfered roller flows the molten plastic material laterally from the chamfered periphery to form narrow thickened container strip side edge weld beads while leaving a thin narrow bridge of the material (substantially the same as the bridge 180) extending between the seal beads. The completed container strips are thus detachably connected by a continuous narrow and very thin bridge of material which readily permits their separation while assuring accurate registration of the container strips.

Although several preferred embodiments of the invention have been illustrated and described in detail, the invention is not intended to be limited to the precise embodiments which have been disclosed. Various modifications, adaptations and uses of the invention may occur to those skilled in the art and this invention is to cover all such modifications, adaptations and uses which come within the scope or spirit of the following claims.

I claim:

1. A method of making elongated container forming strips including the steps of:

a. feeding heat sealable film material along a path of travel;

b. providing a work station at which an operation is performed on the material at least at location spaced transversely of the path of travel as the material is fed through the work station, said operation being performed at successive intervals as said material is fed;

c. maintaining first and second elongated plies of the material in confronting relationship while feeding;

d. heat sealing said plies together along a longitudinal line extending between said transversely spaced locations to form longitudinal seal beads of the ply material on opposite sides of said line while heat sealing;

e. forming a structurally weak, thin, narrow bridge structure having a depth which is substantially less than the depth of the seal beads and which is contiguous with and disposed between said beads while feeding said material; and, f. maintaining said locations transversely aligned while forming said bridge structure.

2. A method as claimed in claim 1, wherein forming said seal beads comprises heating said plies to a molten state along said line while feeding said film material and flowing molten web material in a direction transverse of said path of travel away from said line to produce said beads.

3. A method as claimed in claim 2, wherein forming said bridge structure comprises separating said beads while heat softened, cooling said beads while separated and re-engaging said beads when the beads are cooled to a tacky condition, said bridge structure defined by cohesion of said beads upon reengagement.

4. A method as claimed in claim 2, wherein forming said bridge structure comprises maintaining some molten ply material disposed along said line while flowing molten material transversely from said line with said material along said line cooling to provide said bridge structure.

5. A method as claimed in claim 4, further including displacing all of the molten material from said line at longitudinally spaced locations along said strip to produce spaced openings in said bridge structure.

6. A method as claimed in claim 2, further including displacing all of the molten material from said line at longitudinally spaced locations along said strip to produce spaced openings in said bridge structure.

7. A method as claimed in claim 1, wherein performing an operation on the material comprises producing successive, spaced lines of weakness extending transversely across said material by which formed container strips are longitudinally separable.

8. A method as claimed in claim 7, wherein producing lines of weakness comprises forming elongated slits in at least one ply of said material which slits extend transversely to the direction of feeding, said slits providing loading openings in said container strips.

9. A method as claimed in claim 8, further comprising transversely heat sealing said container strips at longitudinally spaced locations, respective transverse heat seals defining, with respect associated lines of weakness, fillable container portions in said strips.

10. A method of making elongated container forming strips including the steps of:

a. feeding heat sealable film material along a path of travel;

b. providing a work station at which an operation is performed on the material at least at locations spaced transversely of the path of travel as the material is fed through the work station, said operation being performed at successive intervals as said material is fed;

c. maintaining first and second elongated plies of the material in confronting relationship while feeding;

d. heat sealing said plies together by heating said plies to a molten state along a longitudinal line extending between said locations while feeding said film material and flowing molten web material transversely of said path of travel from said line to produce longitudinal seal beads of the ply material on opposite sides of said line while heat sealing;

e. forming a structurally weak, thin, narrow bridge structure contiguous with said seal beads while feeding said material by separating said beads while heat softened, cooling said beads while separated and re-engaging said beads when the beads are cooled to a tacky condition, said bridge structure defined by cohesion of said beads upon re-engagement; and f. maintaining said locations transversely aligned while forming said bridge structure.

11. The method of joining strips of open but separable containers together to register the containers of joined strips comprising:

a. heat softening edges of the container strips;

b. maintaining the strips separated until an integral, partially cooled, bead is formed on each strip, and, c. thereafter bringingthe beads together while still sufficiently warm to be in a tacky state and thereby forming bridges between the strips.

12. The method claimed in claim 11 further including separating the strips while cooling the beads and maintaining the containers of the separated strips registered with each other.

13. The method claimed in claim 12 further including feeding the strips along a path of travel while separating the strips.

14. The method of joining strips of open but separable containers together to register the containers of joined strips comprising:

a. heat softening edges of the container strips to form beads along the edges; and, b. forming bridges of a thickness less than the beads and of the material of the strips, the bridges being formed between the beads while the material is soft whereby to provide connected but separable container strips.

15. Apparatus for joining strips of open but separable containers together to register the containers of joined strips comprising;

a. strip feeding means for advancing the strips along a path of travel;

b. means for heat softening edges of the container strips; and, c. guide structure for separating the strips while the strips are fed along said path until an integral, partially cooled, bead is formed on each strip; and, d. said guide structure including strip engaging surfaces for guiding the beads together while still said beads and still sufficiently heated to be in a tacky state and thereby form bridges between the strips.

* * * * *